US005183164A

United States Patent [19]

Heinzle

[11] Patent Number: 5,183,164

[45] Date of Patent: Feb. 2, 1993

[54] CLAMPING HOLDER FOR SUSPENDING SKIS

[75] Inventor: Egon Heinzle, Laterns, Austria

[73] Assignee: Snowboardklinik Und Handelsges M.B.H., Innsbruck, Austria

[21] Appl. No.: 769,192

[22] Filed: Sep. 30, 1991

Related U.S. Application Data

[63] Continuation-in-part of Ser. No. 537,370, Jun. 13, 1990, abandoned.

[30] Foreign Application Priority Data

Feb. 3, 1989 [AT] Austria ..... 226/89

[51] Int. Cl.[5] ..... A47F 7/00

[52] U.S. Cl. ..... 211/70.5; 248/316.3

[58] Field of Search ..... 211/70.5, 89, 66; 248/316.2, 316.3

[56] References Cited

U.S. PATENT DOCUMENTS

| | | | |
|---|---|---|---|
| 369,318 | 9/1887 | Craine | 248/316.3 X |
| 981,659 | 1/1911 | King | 248/316.3 X |
| 988,180 | 3/1911 | Engelberg | 248/316.3 X |
| 1,589,616 | 6/1926 | Alford | 248/316.3 X |
| 2,869,209 | 1/1959 | Kautzky | 248/316.3 |
| 4,763,797 | 8/1988 | Egan | 211/70.5 |
| 4,798,298 | 1/1989 | Ovsetta | 248/316.3 X |

*Primary Examiner*—Robert W. Gibson, Jr.
*Attorney, Agent, or Firm*—Herbert L. Lerner; Laurence A. Greenberg; Werner H. Stemer

[57] ABSTRACT

A holder for skis includes two clamping jaws which are arranged symmetrically opposite each other relative to a vertical plane. The clamping jaws are mounted so as to be rotatable in dependence on each other about horizontal axes which are arranged parallel to each other and spaced from each other. The axes are defined by bolts which are fastened to a support plate. The clamping jaws have bearing sleeves which surround the bolts. The bearing sleeves have at their ends facing the support plate freely cantilevering arms which are directed toward each other and which are in rotational engagement with one another. The effective surfaces of the clamping jaws which face toward each other are convex arc-shaped, wherein the distance of the imaginary generatrix which forms the arc and which extends parallel to the respective axis from the axis of rotation of the clamping jaw steadily increases from the lowermost arc portion to the uppermost arc portion.

6 Claims, 3 Drawing Sheets

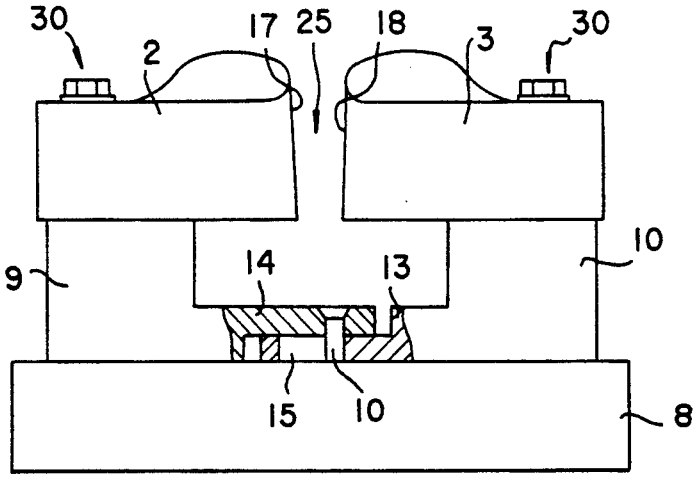
Fig.5
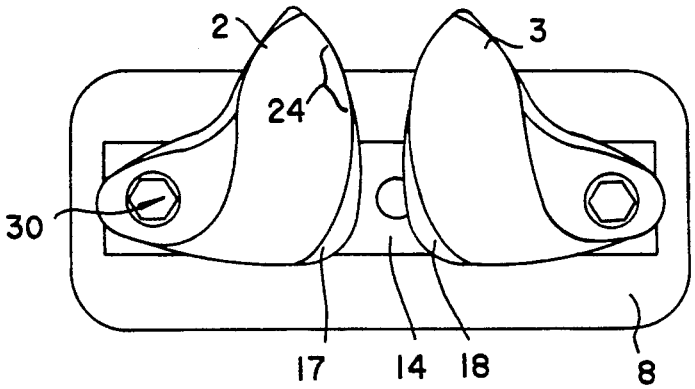
Fig.4
Fig.8
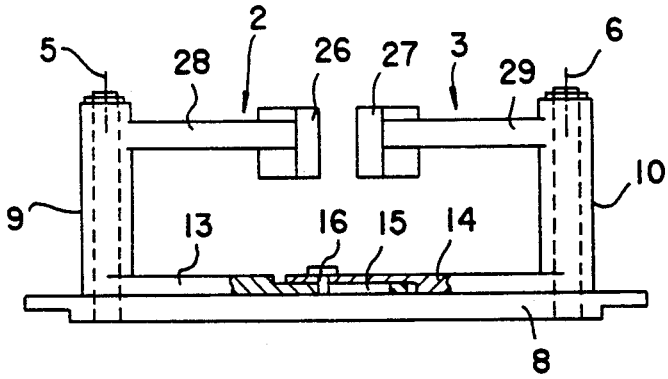
Fig.7
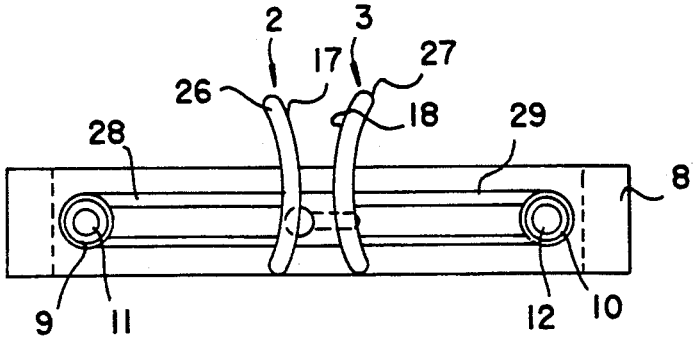

CLAMPING HOLDER FOR SUSPENDING SKIS

CROSS-REFERENCES TO RELATED APPLICATIONS

This application is a continuation-in-part of application Ser. No. 537,370, filed Jun. 13, 1990, now abandoned.

BACKGROUND OF THE INVENTION

1. Field of the Invention

The present invention relates to a holder for suspending skis. The holder includes two clamping jaws which are arranged symmetrically opposite each other relative to a vertical plane. The clamping jaws are mounted so as to be rotatable in dependence on each other about horizontal axes which are arranged parallel to each other and spaced from each other. The axes are bolts which are fastened to a support plate.

2. Description of the Related Art

A number of possibilities have become known for securely suspending skis outdoors, on a wall or on a frame.

Austrian Patent No. 258 771 discloses a holder for suspending pairs of skis in which the holder has a three-sided E-shaped or S-shaped holding stirrup which is pivotally mounted on a horizontal arm. An outer stirrup side is mounted in a bearing sleeve so as to be rotatable about its longitudinal axis. The other outer stirrup side and the middle stirrup side serve to receive the skis. The weight of the skis cause these two stirrup sides to be pressed against two oppositely located surfaces of the pair of skis, wherein the weight of the pair of skis further increases the holding force. In holders of this type, it can always happen that the skis are released and fall down when the skis are unintentionally touched, particularly when the rubber sleeves placed on the stirrup sides are damaged.

In addition, a holder for skis is to be mentioned which includes a support plate with two rotatable rollers arranged next to each other. The axis of rotation of each roller is eccentric to the center axis of the roller. A circular arc-shaped recess is cut into each roller. Compression springs are placed in each recess. The compression springs have the purpose to rotate the two rollers relative to each other. The rollers are covered with rubber linings. The skis are clamped between the two rollers. This device is of very complicated construction. Moreover, the device is also not very practical. The rollers are pressed on as a result of the force applied by the above-described springs. If the skis are to be placed in the holder, the two rollers must be rotated to such an extent that a sufficiently wide gap is created between the rollers, so that the skis can be placed between the rollers. Since each of the two rollers is supported and spring-loaded individually, it is necessarily required for rotating the rollers to use both hands and, therefore, another person is necessary for placing the skis in the open gap between the rollers. This is a very cumbersome manipulation.

A simple holder for handles is known from Swiss patent 365 501. In this holder, two L-shaped jaws are freely and individually pivotable about parallel axes mounted on a support plate. This type of holder is probably sufficient for simple implements with handles, such as brooms or brushes. However, this device is not useful for skis which have a substantial weight. This is because each of the jaws can assume an arbitrary position since the two jaws are freely pivotably mounted. Thus, the handle can be easily moved either to the right or to the left, so that the angle of the jaws relative to the skis are changed, wherein one of the angles is increased and the other is decreased. This results in an instable support which is not useful for heavy objects, such as skis.

U.S. Pat. No. 1,609,666 also shows and describes a simple holder for handles. However, in this case, the two jaws are connected to each other through a common tension spring. In this holder, a symmetrical position of the jaws relative to each other can only be achieved when the two jaws are jointly pivoted upwardly to such an extent that the handle can be inserted and the two jaws can then be returned uniformly until they make contact with the handle. This is because if only one jaw were actuated, the second jaw would assume an angular position which would correspond to the position of the straight line connecting the center of gravity and the point of application of the spring on the other lever. In other words, the two jaws would have a very different angular position relative to the horizontal. The two jaws would only assume the same angle if the two jaws were completely without load. In that case, the jaws are located on the horizontal straight connecting line between the two pivot axes.

SUMMARY OF THE INVENTION

It is accordingly an object of the invention to provide a clamping holder for suspending skis, which overcomes the hereinafore-mentioned disadvantages of the heretofore-known devices of this general type and which is very effective yet simple to manipulate.

With the foregoing and other objects in view there is provided, in accordance with the invention, a holder for suspending skis, comprising support means, two clamping jaws rotatably supported on said support means, the clamping jaws being rotatable about a respective axis of rotation and being supported symmetrically opposite one another relative to a vertical plane, freely cantilevering arms rigidly connected to the clamping jaws in the vicinity of said support means, the cantilevering arms having ends being in mutual rotational engagement for effecting interdependent rotation of the clamping jaws, the clamping jaws having effective surfaces facing toward one another, the effective surfaces being convex with an axis of curvature being oriented substantially perpendicular to the support means and being located at a given distance from the axis of rotation, and a friction layer covering the effective surfaces.

In accordance with another feature of the invention, the holder includes two bolts rigidly mounted on the support means, the bolts extending substantially parallel to one another and substantially perpendicularly to the support means, and including two bearing sleeves forming a part of the clamping jaws and being rotatably mounted on the bolts and having ends facing the support means and opposite ends facing away from the support means, the cantilevering arms being rigidly mounted at the ends facing the support means, and the clamping jaws being rigidly mounted at the opposite ends.

In accordance with yet another feature of the invention, the friction layer has grooves, ribs or knobs for increasing friction between the effective surfaces and the articles to be hung in the clamping holder.

In accordance with a further feature of the invention, the friction layer is formed of a thermoplast which is injection molded or extrusion coated onto the clamping jaws.

In accordance with a concomitant feature of the invention, the holder includes means for effecting mutual rotational engagement of the cantilevering arms. The means may be in the form of an oblong hole formed in one of the arms and a bolt formed on the other of the arms, wherein the bolt engages in the hole. Another embodiment of the engagement means may be in the form of tootings formed on the ends of the arms for meshing with one another.

In other words, and summarizing the invention, the clamping jaws have bearing sleeves which surround the bolts. At the ends of the bearing sleeves facing the support plate, freely cantilevering arms are arranged which are directed toward each other, wherein either the end of one arm has an oblong hole and the end of the other arm has a bolt which engages in the oblong hole of the first arm or toothings are provided at the ends of the arms which toothings mesh with each other. The effective surfaces of the clamping jaws which face toward each other are convex arc-shaped, wherein the distance of the imaginary generatrix which forms the arc and which extends parallel to the respective axis from the axis of rotation of the clamping jaw steadily increases from the lowermost arc portion to the uppermost arc portion.

Accordingly, when one of the clamping s is swung upwardly, the other clamping jaw is automatically also moved upwardly until the gap between the two clamping jaws is widened to such an extent that the skis can be placed in the gap. Since the two clamping jaws are rotatable in dependence upon each other, it is always ensured that the portions of the two clamping jaws which press against the ski or against the pair of skis are located directly opposite each other, so that the clamping jaws cannot be clamped in an inclined position and, thus, the ski or the pair of skis cannot be released unintentionally.

Other features which are considered as characteristic for the invention are set forth in the appended claims.

Although the invention is illustrated and described herein as embodied in a clamping holder for suspending skis, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

BRIEF DESCRIPTION OF THE DRAWINGS

FIG. 4 is a front view of another embodiment of the holder according to the invention;

FIG. 5 is a bottom view of the holder of FIG. 4:

FIG. 7 is a front view of yet another embodiment of the holder of the invention;

FIG. 8 is a bottom view of the holder of FIG. 7;

DESCRIPTION OF THE PREFERRED EMBODIMENTS

Figure 1:
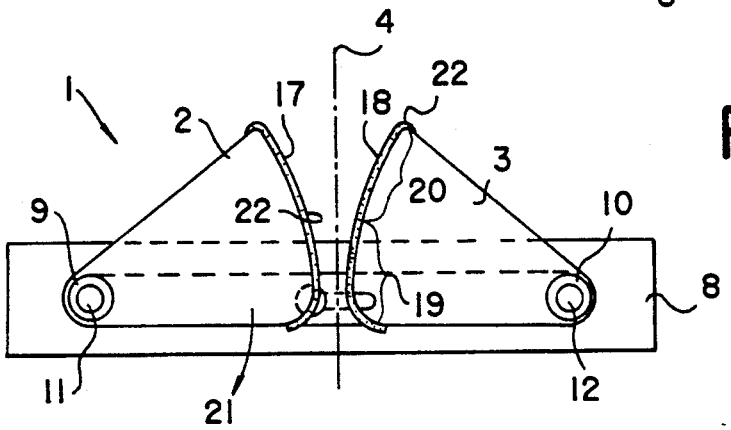
FIG. 1 is a front-elevational view of a holder according to the invention.

Referring now to the figures of the drawing in detail and first, particularly, to FIG. 1 thereof, there is seen a holder 1 according to the present invention which includes two clamping jaws 2 and 3. The clamping jaws 2 and 3 are mounted symmetrically relative to each other with respect to a vertical plane 4. The two jaws 2 and 3 are mounted so as to be rotatable about substantially parallel horizontal axes 5, 6 which are spaced apart from each other. It is provided that the two clamping jaws 2 and 3 can only rotate in dependence upon each other, so that the clamping effects of the two clamping jaws 2 and 3 are always coordinated with each other, i.e., the two clamping jaws 2 and 3 are always pressed against the skis at portions which are located directly opposite each other.

The clamping jaws 2 and 3 are rotatable in a plane 7 which is spaced apart from a support plate 8. This distance from the support plate ensures that the skis are always clamped by the holder in the middle portion of the skis relative to the width thereof. The clamping jaws 2, 3 are fastened on bearing sleeves 9, 10 which surround the bolts 11, 12 which form the axes of rotation 5, 6. This also ensures that the clamping jaws 2, 3 are securely fastened and supported.

At the ends of the bearing sleeves 9, 10 which face the side of the support plate, freely cantilevering arms 13, 14 are attached, whose ends are in operative connection with each other. The arms 13, 14 result in a uniform movement of the two clamping jaws 2 and 3. One possibility for constructing the operative connection is to provide the end of the arm 13 with an oblong hole 15 and to arrange a bolt 16 at the end of the other arm 14 which bolt 16 engages in the oblong hole 15 of the arm 13.

Within the scope of the invention it is also conceivable to provide a different configuration for the operative connection between the arms, while still ensuring the interdependent rotation of the two clamping jaws 2 and 3. For example, it would be possible to provide toothings at the ends of the two arms 13 and 14, so that the ends of the arms 13 and 14 mesh with each other in the manner of gear wheels.

In order to ensure that always only a relatively short portion of the effective surfaces 17, 18 of the clamping jaws 2, 3 which face each other are pressed against the skis, these surfaces 17, 18 extend in the shape of a convex arc. The distance of the generatrix forming the arc steadily increases from the lowermost are portion 19 to the uppermost arc portion 20. Accordingly, the clamping jaws 2, 3 have eccentric surfaces, so that the pressing force between the two clamping jaws 2, 3 increases and the distance between the two effective surfaces 17, 18 decreases as the two clamping jaws 2 and 3 are pivoted downwardly in the direction of arrow 21. The effective surfaces 17, 18 of the clamping jaws 2, 3 which face each other may also be circular arc-shaped, however, in this case, the center of the circular arc does not coincide with the respective axis of rotation 5 or 6 of the clamping jaws 2, 3. As a result, an eccentric operation of the clamping jaws 2, 3 is always provided.

Figure 2:
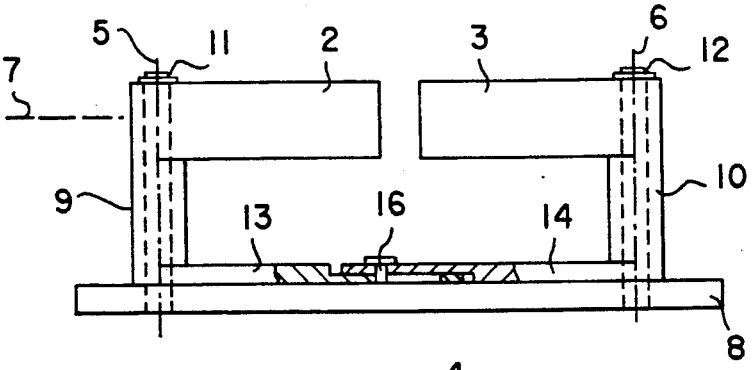
FIG. 2 is a bottom view of the holder of FIG. 1.
Figure 3:
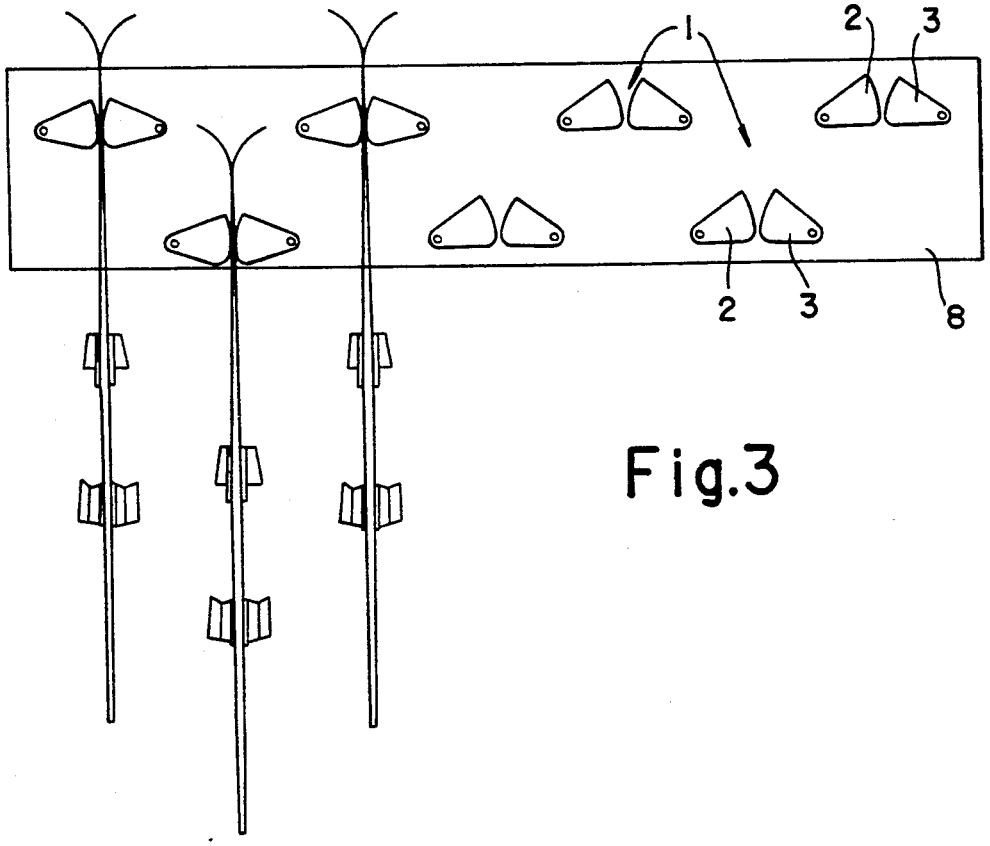
FIG. 3 shows the possible arrangement of several holders on a wall or on a support frame.

In the embodiment shown in FIGS. 1 and 2, a support plate 8 is provided on which the two clamping jaws 2 and 3 are rotatably fastened. The support plate 8 can be mounted on a wall or on a frame. However, it would also be possible, as shown in FIG. 3, to provide a plurality of pairs of clamping jaws 2, 3 on a support plate 8 of appropriate size, or to fasten these pairs of clamping jaws 2, 3 directly on a plate of a frame or on a wall. Accordingly, an arrangement of the clamping jaws 2, 3 on any type of support means is possible. When the holders 1 are vertically and horizontally offset relative to each other, as shown in FIG. 3, a substantially greater number of skis can be suspended next to each other in a certain unit of space.

It is very simple to place the skis in a holder 1. It is only necessary to press the side edges of the skis against the clamping jaws 2, 3, so that an appropriate upward movement causes the two clamping jaws 2 and 3 to be swung in a direction against the direction of arrow 21. As soon as sufficient space opens up between the two clamping jaws 2 and 3, so that the skis can be placed in the gap between the clamping jaws 2 and 3, the skis slide between the clamping jaws 2 and 3. It is then only necessary to release the skis because the clamping jaws 2, 3 are automatically swung downwardly in the direction of arrow 21 as a result of the own weight of the clamping jaws 2, 3. As soon as the surfaces of the skis come into contact with the effective surfaces 17 and 18 of the clamping jaws 2 and 3 and, thus, the weight of the skis also acts on the clamping jaws, the skis are properly clamped because the weight of the skis alone pulls the clamping jaws 2 and 3 further downwardly in the direction of arrow 21. Accordingly, two equal opposing forces act on the skis through the effective surfaces 17, 18 and thus adapt the necessary frictional force to the weight of the skis or other item to be held.

In mechanical terms, the weight (mg) of the skis must be opposed by a vertically upward force vector at least equal to the weight.

To ensure that the skis are securely supported, i.e., for increasing the friction between the effective surfaces 17, 18 of the clamping jaws 2 and 3, and the skis, it is advantageous if the surfaces 17, 18 of the clamping jaws 2, 3 are provided with teeth, ribs, knobs or are roughened. To obtain a gentle pressing of the clamping jaws 2 and 3 against the skis, it is advantageous if a friction layer 22 on the effective surfaces 17, 18 is provided with grooves, ribs, knobs.

It has been found to be particularly advantageous to apply a high-friction layer 22 to the effective surfaces 17, 18. Since the clamping jaws 2, 3 are preferably formed of polyamide with approximately 30% reinforcing glass fibers, a thermoplast is used for the friction layer 22. During the molding process, the thermoplast and the polyamide and glass fiber form an integrated transition layer, i.e. they are melted together in their respective border regions and form a very good bond.

The correct hardness of the thermoplast, which is approximately 30 shore, its composition and the outer structure which is shown as ribs, knobs, and the like, are quite important for the proper functioning of the device according to the invention. In other words, it must be ascertained that the thermoplast friction layer 22 does not leave markings on the skis and also, the proper bond between the effective surfaces 17, 18 and the friction layer 22 must be ensured.

A good bond between the two materials of the clamping jaws 2, 3, on the one hand, and the thermoplastic friction layer 22, on the other hand, is quite essential. The holder of the instant invention is subject to rough handling and subject to substantial forces when the skis are hung and then remain there for some length of time. Tests conducted by this inventor have shown that even superglue cannot withstand this prolonged force, which results in the formation of pockets between the friction layer 22 and the clamping jaws 2, 3.

The clamping jaws 2 and 3 may be constructed in a simple manner either composed of several parts or as single-piece members. Thus, it is conceivable to integrally cast the clamping jaws 2, 3 together with the bearing sleeves 9, 10 and the arms 13, 14 from plastics material or metal.

The thermoplastic material, i.e. partially thermoplastic material, is commercially available under the mark THERMOLAST K from the firm Gummiwerk Kraiburg, Kraiburg, Germany. The material has elastomeric characteristics and its mechanical specifications can easily be varied and thus adapted to the specific requirements. The friction layer is highly resistant to water, many aqueous solutions, including inorganic acids and bases, as well as to ozone and UV-radiation. The molecular structure of THERMOLAST K may be described as S-EB-S, where thermoplastic polystyrol end blocks frame elastic ethylene-butylene center blocks. The THERMOLAST K compound is based on a base polymer which is available under the commercial name KRATON G from Shell Company.

The presently preferred mode of manufacturing the clamping holder of the invention is the following: The clamping jaws are injection molded from polyamide which is reinforced with glass fibers. The jaws are cooled down and dried. Then the hardened jaws 2, 3 are placed in a new mould. Now the thermoplastic material is injection molded onto the effective surfaces 17, 18 on the clamping jaws 2, 3. This last method step is performed at a temperature of between 200° and 240° C., which ensures a proper fusion between the reinforced polyamide and the thermoplastic material.

In an alternative mode of manufacturing the clamping holder, the clamping jaws 2, 3 and with it the friction surfaces 22 are formed in a single moulding step.

Figure 6:
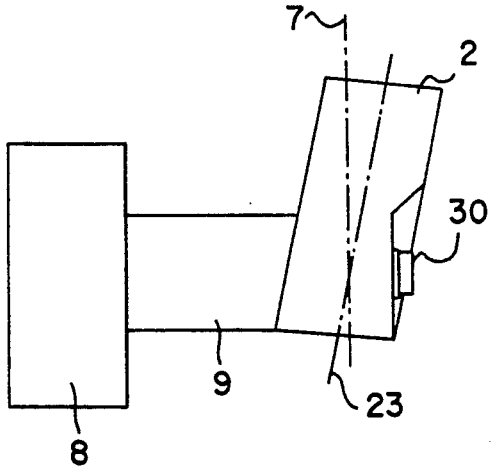
FIG. 6 is a side view of the holder of FIG. 4.

The embodiment shown in FIGS. 4–6 includes the additional feature that the center plane 23 of the clamping jaws 2, 3 is inclined at an acute angle relative to the pivoting plane 7 of the clamping jaws 2, 3 as particularly shown in FIG. 6. In addition, the effective surfaces 17, 18 of the clamping jaws 2, 3 which face each other have a twisted shape. These features ensure that the skis can be more easily inserted between the two clamping jaws and, moreover, that the skis are safely and securely clamped between the two effective surfaces 17, 18. In accordance with another feature, at least one of the imaginary generatrices extending transversely to the center plane 23 of the clamping jaws 2, 3 is directed parallel to the axis of rotation 5 or 6 of the clamping jaws 2, 3. Accordingly, this refers to that portion which, as a rule, rests against the ski when the ski is clamped by the holder. In the region in which the ski finally is clamped between the clamping jaws 2, 3, it is advantageous if support of the skis is provided over the entire width of the effective surfaces 17, 18 of the clamping jaws 2, 3.

Therefore, it is also proposed that a portion 24 with a generatrix extending parallel to the axis of rotation 5, 6 of clamping jaws 2, 3 is provided in the upper half of the clamping jaws 2, 3 in relation to the length of the effective surfaces 17, 18 of the clamping jaws 2, 3.

In the region of the lower halves of the effective surfaces 17, 18 of the clamping jaws 2, 3 the twisted shape of the surfaces 17 and 18 results in an opening 25 which constantly widens toward the front. This makes it possible for the skis to penetrate the gap between the two clamping jaws 2, 3 as soon as the skis are placed against the jaws 2, 3 so that the clamping jaws 2, 3 can be pivoted even more easily toward the top until the skis can finally be placed between the two clamping jaws 2 and 3.

In the embodiment shown in FIGS. 7 and 8 of the drawing, merely the structure of the clamping jaws 2, 3 has been changed. In this embodiment, the clamping jaws 2, 3 are formed by arc-shaped members 2, 3 which have the effective surfaces 17 and 18 and include cantilevering arms or support stirrups 28, 29 which provide the connection to the two bearing sleeves 9 and 10.

It is apparent from the three embodiments described above that a variety of constructions of the clamping jaws 2 and 3 are possible. However, in all of these constructions it is necessary that the clamping jaws 2 and 3 are arranged symmetrically relative to each other and are pivotable in dependence upon each and about axes of rotation which are spaced apart from each other. Thus, it would not be sufficient to provide a fixed stop on one side and to provide only one of the two clamping jaws 2 or 3 because this would mean that the contact pressure force would depend too much from the surface friction of the effective surface 17 or 18 and of the fixed stop. In accordance with the invention, on the other hand, the interdependent rotation of the clamping jaws 2 and 3 always ensures that the optimum pressing force acts on the surfaces of the skis.

The bolts 11 and 12 which form the axes of rotation 5 and 6 may be fixed in the support plate 8. However, it is also possible that the bolts 11, 12 are formed by the shaft of a screw 30, wherein this screw simultaneously serves to fasten the clamping jaws 2, 3 at the support plate 8 or another appropriate support means.

Figure 9:
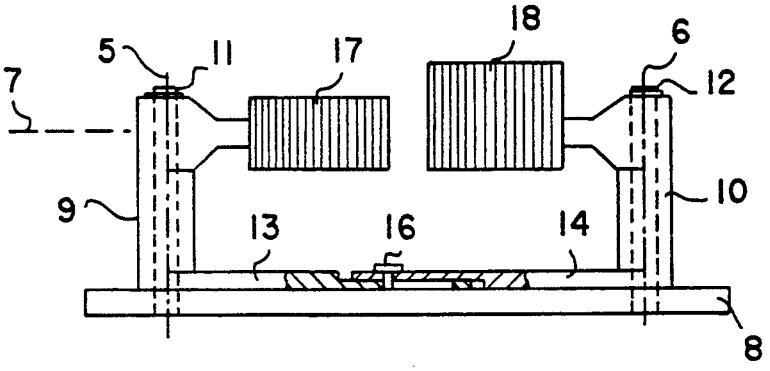
FIG. 9 is a bottom view of a preferred embodiment of the invention.
Figure 10:
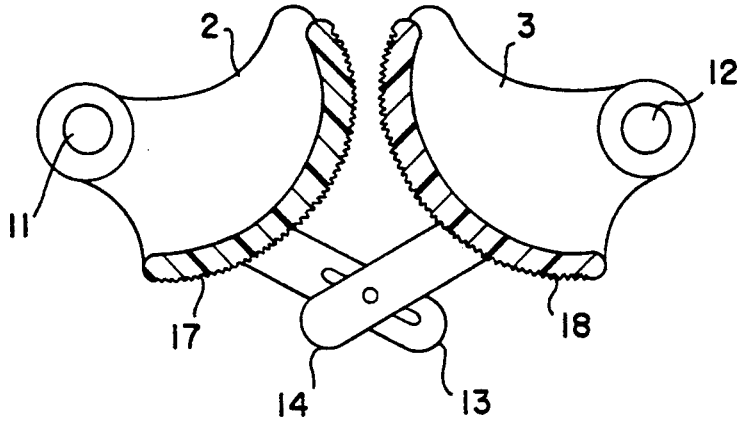
FIG. 10 is a front-elevational view of the holder of FIG. 9.

FIGS. 9 and 10 illustrate particularly advantageous embodiments of the invention. The effective surface 18 is widened as compared to the surface 17. Accordingly, it is particularly easy to insert skis or the like in the clamping holder. In the embodiment shown in FIG. 9, one would simply approach the holder from the left hand side until the skis touch that portion of the surface 18 which extends out farther than the surface 17. By moving the skis upwards, the lever arm 14, through the pin 16, forces the lever arm 13, and thus the clamping jaw 2, to move in the same direction. When the clamping opening between the jaws 2, 3 is wide enough, the skis can be slid toward the support plate 8, and then released. The ensuing clamping action has been described above.

As clearly seen in FIG. 10, the arcs have centers of curvature which are located above the respective axes of rotation 5, 6 of the clamping jaws 2, 3.

The holder according to the present invention has been explained with respect to the use for suspending skis. However, the holder is also especially suitable not only for suspending cross-country skis, but also for monoskies and snowboards. This is because the proper support is independent of the width of the plane portion of the article to be suspended.

While specific embodiments of the invention have been shown and described in detail to illustrate the application of the inventive principles, it will be understood that the invention may be embodied otherwise without departing from such principles.

I claim:

1. A holder for suspending skis, comprising support means, two clamping jaws rotatably supported on said support means, said clamping jaws being rotatable about a respective axis of rotation and being supported symmetrically opposite one another relative to a vertical plane, freely cantilevering arms rigidly connected to said clamping jaws in the vicinity of said support means, said cantilevering arms having ends being in mutual rotational engagement for effecting interdependent rotation of said clamping jaws, said clamping jaws having effective surfaces facing toward one another, said effective surfaces being convex with an axis of curvature being oriented substantially perpendicular to said support means and being located at a given distance from said axis of rotation, and a friction layer formed of thermoplastic material covering said effective surfaces.

2. A holder for suspending skis, comprising support means, two clamping jaws rotatably supported on said support means, said clamping jaws being rotatable about a respective axis of rotation and being supported symmetrically opposite one another relative to a vertical plane, freely cantilevering arms rigidly connected to said clamping jaws in the vicinity of said support means, said cantilevering arms having ends being in mutual rotational engagement for effecting interdependent rotation of said clamping jaws, said clamping jaws having effective surfaces facing toward one another, said effective surfaces being convex with an axis of curvature being oriented substantially perpendicular to said support means and being located at a given distance from said axis of rotation, a friction layer covering said effective surfaces, and including two bolts rigidly mounted on said support means, said bolts extending substantially parallel to one anther and substantially perpendicularly to said support means, and including two bearing leaves forming a part of said clamping jaws and being rotatably mounted on said bolts and having ends facing said support means and opposite ends facing away from said support means, said cantilevering arms being rigidly mounted at said ends facing said support means, and said clamping jaws being rigidly mounted at said opposite ends.

3. The holder according to claim 1, wherein said thermoplastic friction layer has grooves, ribs or knobs for increasing friction.

4. The holder according to claim 1, wherein said thermoplastic material is injection molded onto said clamping jaws.

5. The holder according to claim 1, wherein said thermoplastic material is extrusion coated onto said clamping jaws.

6. The holder according to claim 1, including means for effecting mutual rotational engagement of said cantilevering arms, said means being in the form of an oblong hole formed in one of said arms and a bolt formed on the other of said arms, wherein said bolt engages in said hole.

* * * * *

UNITED STATES PATENT AND TRADEMARK OFFICE

CERTIFICATE OF CORRECTION

PATENT NO. : 5,183,164
DATED : February 2, 1993

INVENTOR(S) : Egon Heinzle

It is certified that error appears in the above—identified patent and that said Letters Patent is hereby corrected as shown below:

On the title page, item [73] delete assignee.

Signed and Sealed this

Sixteenth Day of November, 1993

*Attest:*

BRUCE LEHMAN

*Attesting Officer*

*Commissioner of Patents and Trademarks*